US005152626A

United States Patent [19]

Eppler

[11] Patent Number: 5,152,626

[45] Date of Patent: Oct. 6, 1992

[54] WRITING PEN WITH RETRACTABLE CLIP

[75] Inventor: Günter Eppler, Leimen, Fed. Rep. of Germany

[73] Assignee: C. Josef Lamy GmbH, Heidelberg, Fed. Rep. of Germany

[21] Appl. No.: 595,868

[22] Filed: Oct. 10, 1990

[30] Foreign Application Priority Data

Oct. 10, 1989 [DE] Fed. Rep. of Germany ..... 3933789

[51] Int. Cl.[5] ..... B43K 7/12; B43K 24/08; B43K 25/00

[52] U.S. Cl. ..... 401/104; 401/106

[58] Field of Search ..... 401/104, 105, 106

[56] References Cited

U.S. PATENT DOCUMENTS

| | | | |
|---|---|---|---|
| 2,583,142 | 1/1952 | Frentzel . | |
| 2,671,354 | 3/1954 | Goos . | |
| 3,101,075 | 8/1963 | Johmann . | |
| 3,179,088 | 4/1965 | Johmann . | |
| 3,237,004 | 3/1966 | Johmann . | |

FOREIGN PATENT DOCUMENTS

| | | | |
|---|---|---|---|
| 722976 | 12/1965 | Canada | 401/106 |
| 1511330 | 9/1969 | Fed. Rep. of Germany . | |
| 7244435 | 5/1973 | Fed. Rep. of Germany . | |
| 3024154 | 1/1982 | Fed. Rep. of Germany | 401/104 |
| 3046093 | 2/1986 | Fed. Rep. of Germany . | |
| 3606336 | 9/1987 | Fed. Rep. of Germany . | |
| 2225298 | 11/1974 | France . | |
| 286888 | 3/1953 | Switzerland | 401/104 |
| 2234999 | 1/1975 | Switzerland . | |

*Primary Examiner*—Steven A. Bratlie
*Attorney, Agent, or Firm*—Foley & Lardner

[57] ABSTRACT

A writing instrument including a clip which can be retracted into an opening of a barrel, and an operating unit which has a pushbutton and an operating cam. The writing instrument can be operated by a single operating means, while the clip can function only when the writing cartridge is retracted. The operating cam and a guide slot are disposed in a common cam member connected with the pushbutton. The clip has a projection which terminates in the interior of the barrel and engages the guide slot.

30 Claims, 6 Drawing Sheets

WRITING PEN WITH RETRACTABLE CLIP

BACKGROUND OF THE INVENTION

This invention relates to a writing instrument having a pocket clip and an ink cartridge which are each retractable into the pen body by actuating a pushbutton.

U.S. Pat. No. 3,101,075 discloses a writing instrument, having a clip made in one piece with a pushbutton. In the barrel of the writing instrument, a guide groove extending at an angle to the longitudinal axis is associated with the pushbutton. Upon actuation, the pushbutton and also the clip made in one piece therewith not only move in the direction of the longitudinal axis but also transversely of the longitudinal axis. Furthermore, a control unit comprising an upper annular element and a lower annular coupling element is provided separately from the pushbutton. By depressing the pushbutton the clip can be pushed laterally out of the barrel, and after the pushbutton is released, the margin of a pocket or the like, for example, can be gripped between the clip and the barrel. The clip is operated exclusively by means of the pushbutton. In order to retract the ink cartridge into the barrel, the tip of the ink cartridge is pressed against a hard surface, while an axially displaceable sleeve at the front end of the barrel is pushed back into the interior of the barrel. This shifts the coupling means into a rest position. To extend the ink cartridge out of the barrel, the sleeve and the tip of the ink cartridge are again pressed upon a hard surface thereby actuating coupling parts of a cam, so that the ink cartridge is shifted to the writing position. In the retracted position the tip of the cartridge is close to the front end of the writing instrument, but its distance away from it cannot be easily increased since the maximum movement of the ink cartridge is determined by the shapes of the cam and the coupling parts, and by their axial length. Furthermore, even when the cartridge is extended, the writing instrument can be fastened to an article of clothing, with the danger that the clothing may be stained by leaking writing fluid. The clip can be extended out of the barrel by actuating the pushbutton regardless of the position of the ink cartridge.

Another writing instrument is disclosed in German Patent No. DE 30 46 093, which has a clip arranged so as to be retractable into an opening in a barrel. The operating unit comprises a pushbutton and a control or operating cam for holding the cartridge in the writing position or in the position in which it is retracted into the barrel. At the upper end of the clip there is an operating head which engages the opening in the barrel on the one side, passes through the barrel, projects from the barrel on the side opposite the clip, and there has an exposed operating surface. The cartridge is extended from the barrel by pressing the pushbutton which protrudes from the upper end of the barrel, causing the clip to retract such that on the opposite side the operating head with its operating surface protrudes from the barrel. In the writing position, the pushbutton, and hence the cartridge, is held by means of a guide projection which is disposed on the operating head, and which snaps into a locking surface provided at the upper end of the cam. To retract the cartridge back into the barrel a user must act upon the operating surface to press the operating head projecting from this side of the barrel radially inwardly toward the longitudinal axis of the barrel, releasing the guide projection from the locking surface and, on the other side, shifting the clip out of the barrel. The locking surface and the guide projection are subjected to relatively great stress and wear. Arranging the cam above the end of the cartridge for the actuation of the cam creates corresponding bulk. To operate the cartridge a user must act at two different points, namely at the pushbutton at the upper end of the instrument to deploy the cartridge and at a lateral operating surface of the operating head to retract it. This makes operation inconvenient. In writing, the operating head with its operating surface protruding laterally from the barrel can be disadvantageous, and accidental retraction of the cartridge may occur when handling or putting down the writing instrument, or even while writing with it.

French Patent No. FR 22 25 298 discloses a writing instrument in which the clip is a component of the pushbutton. In this writing instrument too, when the clip is actuated, it moves both in the direction of the longitudinal axis and transversely of the longitudinal axis. No additional information is found in this disclosure about the design of a guide cam or operating cam.

German Utility Model No. DE-U 72 44 435 relates to a writing instrument having a clip and a writing part which can be deployed to a writing position and retracted to a rest position. Here the clip is disposed substantially within the circumferential limits of the barrel of the writing instrument. The writing part is deployed and retracted by means of an actuator which is configured as a pushbutton at the rearward end of the barrel. The clip is connected to the actuator by a resilient swivel connection. The clip and the actuator consist of a single piece, and the resilient swivel connection is achieved by the shaping and the elasticity of the material.

SUMMARY OF THE INVENTION

It is therefore the object of the present invention to provide an improved writing instrument of the above-described type which can be operated by a "push-push" actuation through a single operating means.

Another object of the invention to provide a writing instrument in which the cartridge is retracted into the barrel a sufficient distance that any textile fibers which might enter the barrel will not interfere with the cartridge and will be unable to contact the tip of the cartridge.

It is also an object of the invention to provide a writing instrument which is designed to reliably assure that the clip is usable only with the cartridge in the retracted position, so that it is impossible for a user to pocket the writing instrument with the cartridge extended, soiling articles of clothing or the like with ink from the cartridge tip.

A further object is to provide a writing instrument which can be manufactured without difficulty and which assures that the pocket clip can function only when the cartridge is retracted, but cannot be used with the cartridge deployed.

An additional object of the invention is to provide a writing instrument which is so constructed that it can be manufactured by efficient methods of production, especially all-automatic production.

These and other objects of the invention are achieved by providing a writing instrument comprising a barrel, an ink cartridge arranged within the barrel and having a writing tip, a clip arranged for retraction into an opening in the barrel, a pushbutton, and an operating unit operated by said pushbutton comprising an operating cam for moving the ink cartridge forward and backward in the barrel to extend or retract the writing tip of the ink cartridge and a guide slot for controlling the clip, wherein the guide slot and the operating cam are arranged on a common cam member, the cam member is connected to and actuated by the pushbutton, and the clip has a projection which terminates interiorly of the barrel and is engaged in the guide slot.

The writing instrument according to the present invention is characterized by reliable design and simple operation. The operation is performed exclusively with the pushbutton, and when it is actuated the clip is deployed out of the barrel or retracted into the barrel, transversely of the longitudinal axis of the writing instrument. When the cartridge is in the deployed writing position the clip is completely retracted into the barrel, and the handling of the instrument is not impaired by an operating surface or an operating head. Since the clip is retracted into the barrel when the cartridge is deployed to the writing position, when the writing instrument is laid aside the cartridge, cannot be retracted unintentionally by means of the clip. Only a single operating means is present, namely the pushbutton, and both the cartridge and the clip are operated in common exclusively by the "push-push" action. In addition to the operating cam by means of which the position of the cartridge is controlled in the customary manner, a second, guiding cam is associated with the pushbutton, by means of which the deployment of the clip and its withdrawal into the barrel are brought about. Because of the structural and spatial separation of the operating cam from the guiding cam, the cams can be optimized independently of one another; wear is minimized, and a long life is assured. The operating cam is disposed laterally beside the cartridge on a prolongation which is advantageously configured as a narrow tongue. It is apparent that, when the cartridge is extended, the clip is withdrawn into the barrel, and vice-versa. In comparison with known writing instruments a relatively long movement of the cartridge is achieved. In the retracted position the cartridge tip is a large distance from the tip of the writing instrument, namely greater than 3 mm, preferably greater than 4 mm, so that great security against the entrance of textile fibers is achieved. This is especially important in the case of cartridges containing writing fluid which might be absorbed by textile fibers penetrating into the barrel all the way to the cartridge tip.

BRIEF DESCRIPTION OF THE DRAWINGS

The invention will be explained in further detail with reference to a non-limiting preferred embodiment illustrated in the accompanying drawings in which.

As used herein, references to the front direction refer to the direction toward the writing tip of the writing instrument, and references to the rear direction refer to the direction toward the pushbutton end of the writing instrument.

DETAILED DESCRIPTION OF PREFERRED EMBODIMENTS

Figure 1:
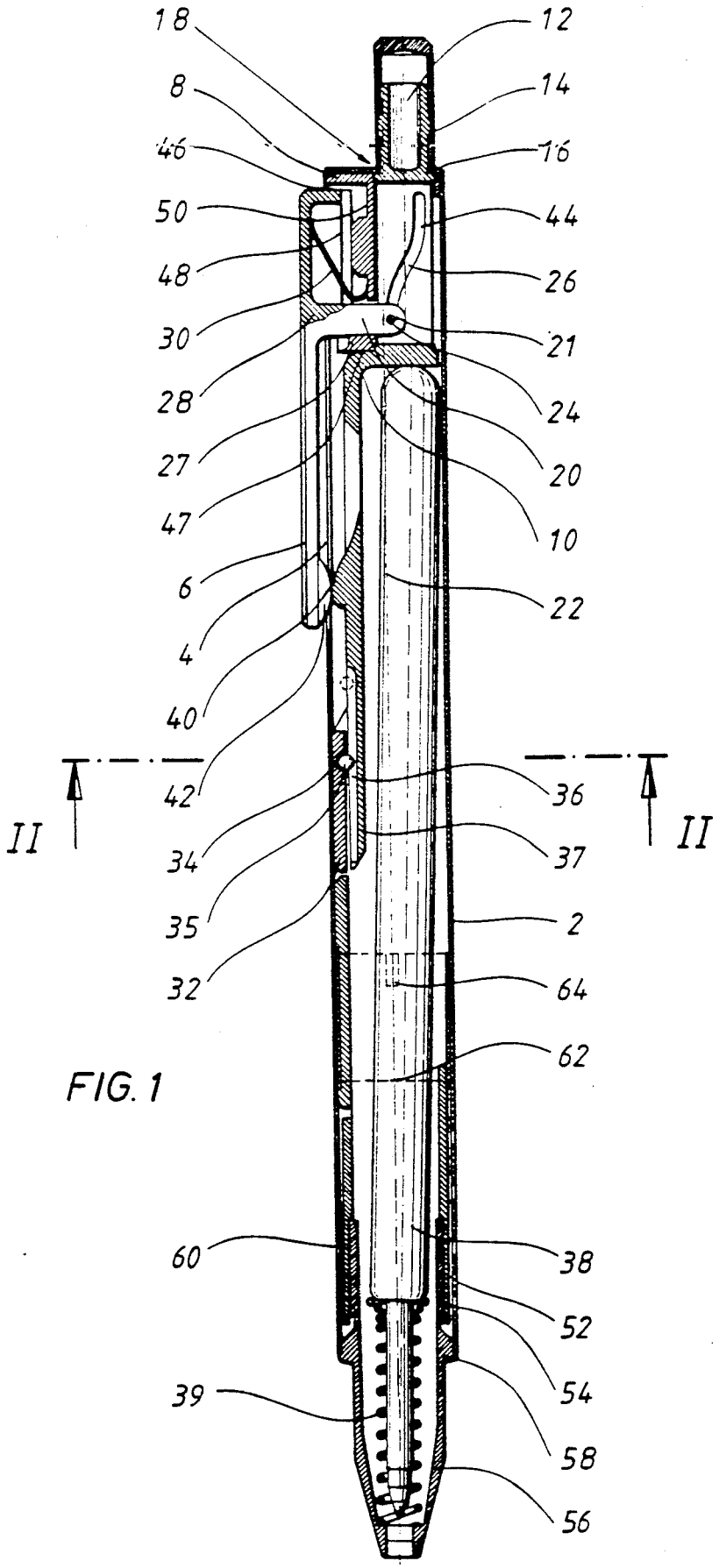
FIG. 1 is an axial section through the writing instrument with the clip deployed and the cartridge retracted.

FIG. 1 shows the housing 2 in the form of a tube, which is also called the barrel. Barrel 2 is provided with a recess or opening 4 toward its rearward end for a pocket clip 6. In the interior of the barrel 2 are a guide member 8 and a cam member 10 at whose rearward end, which here protrudes out of the barrel 2, there are a pushbutton 12 and a surrounding pushbutton sleeve 14. The pushbutton 12 may advantageously be an integral part of the cam member 10. The barrel is closed off at its rearward end by a top cap 16 having an opening 18 through which the pushbutton 12 protrudes. The clip 6 comprises a projection 20 which extends into the barrel 2 perpendicular to the longitudinal axis 22, and is guided by a pin 24 in a guide slot 26 in the cam member 10. The end 21 of the projection 20 lies within the barrel. In the rearward end position shown in the drawing, the cam member 10 contacts the guide member 8 with a rear abutment 27 of a prolongation extending forward to about the middle of the barrel 2. Above the projection 20 the clip 6 has an end section 28 with a receptacle for a clip spring 30. The end section 28 has lateral flanks within the barrel 2 which contact the inner sides of the clip opening 4 in the barrel 2 when the clip is deployed. This assures that the back of the clip will be parallel to the line of the barrel 2 when the clip is deployed. The clip is resiliently biased against the guide member 8 by the spring 30. In the illustrated position the clip 6 is deployed out of the barrel 2 and can be pivoted about the pin 24 against the force of the spring 30 in order, for example, to clip the writing instrument to the edge of a pocket of an article of clothing. The clip is substantially rigid, and the required clamping force is applied to the article of clothing or the like through the front end of the clip 6 by means of the spring 30 which engages the inside of the end section 28. With the exception of the barrel 2, the above-named parts form the operating unit, i.e., the mechanical assembly which is designed for actuating the cartridge and the clip, and which is in the form of a preassembled unit. As will be explained below, during manufacture this preassembled unit is inserted into the rearward end of the barrel 2 and anchored there.

The guide member 8 extends from the rearward end of the barrel 2 to approximately the middle of the barrel and there it comprises an annular portion 32 which has a small groove 34 in its interior. In this groove 34 can be seen a ball 35 which engages an operating cam 36 on the outer surface of cam member 10. The operating cam 36 is arranged on an extension of cam member 10 formed as a tongue 37. This tongue 37 is radially received in the guide member, as explained in detail hereinafter, whereby a high degree of operational reliability is assured. This operating cam 36 is designed as a heart cam in order to shift the cartridge 38 out of the writing instrument, or to retract the cartridge with the assistance of a cartridge spring or return spring 39, when the pushbutton 12 is depressed. The axis of the cartridge 38 is inclined at an angle to the longitudinal axis 22 of the barrel 2, with the two axes intersecting at the tip of the writing instrument. The cartridge is advantageously inclined in the same axial plane in which the clip 6 and the tongue 37 with the operating cam 36 are arranged, but on the other side with respect to the longitudinal axis 22. Due to this angular position, the diameter of the barrel 2 can be made small despite the arrangement of the tongue 37 with the operating cam 36 alongside the cartridge 38.

The cam member 10 furthermore comprises a cam lobe 40 for the front end 42 of the clip 6. Spring 30 urges the clip front end 42, which is constructed as a clamp and has a curved contour, against the cam lobe 40 of the cam member 10. The guide slot 26 and the cam lobe 40 are coordinated with the clip front end 42 such that, when the pushbutton 12 is actuated, the clip 6 moves substantially parallel to the longitudinal axis 22. If the cam member 10 is moved forward from the rearward end position here shown, the clip 6 will be displaced by the pin 24 along the guide slot 26 parallel to the longitudinal axis 22. The parallel alignment of the clip 6 is assured by the spring 30 in cooperation with the cam lobe 40. If the cam member 10 is moved forward from the illustrated position, then the pin 24 will lie in the rear portion 44 of the guide slot 26, and the clip will be entirely retracted into the barrel 2, while at the same time the forward tip of the cartridge will be deployed to the writing position and held there by the operating cam 36 until the pushbutton 12 is operated again. In this position the spring 30 is compressed and the end section 28 of the clip is pulled into the opening 46 of guide member 8. The end portion 28 then lies with its inner edge 48 substantially at the bottom 50 of the opening 46, thus forming an abutment for the clip. Because of this abutment, any outward pivoting of the clip, and hence any attachment of the writing instrument to an article of clothing, is reliably prevented. The guide member 8 includes a forward-facing surface 47 which engages the abutment 27 to limit the rearward movement of the cam member 10 after the pushbutton 12 has again been actuated.

In the forward end of the barrel 2 there is a threaded sleeve 52 having an internal thread 54 into which the externally threaded front end piece 56 can be screwed. The front end piece 56 comprises an annular bead 58 which limits the depth to which it can be screwed into the barrel 2. The barrel 2 has perforations 60 at its forward end, i.e., the finger grip area. The barrel 2 contains in its interior a sleeve 62 surrounding the rearward end of the threaded sleeve 52. Sleeve 62 is fixedly connected to the barrel 2, preferably by adhesive bonding or welding. In accordance with the invention this sleeve 62 can also be an integral part of the barrel 2, if the barrel is made of plastic, for example, in which case the sleeve is preferably made in one piece with the barrel 2. The sleeve 62 contains at least one longitudinal slot 64 open at the rear end, which serves to hold and align the threaded sleeve 52 with respect to the barrel 2. The sleeve 62 lies in front of the forward end of the guide member 8, which is engaged with the threaded sleeve 52 by connecting elements described hereinafter. Guide member 8 is also fixed circumferentially with respect to the threaded sleeve 52 by these connecting elements, so that the clip 6 is also definitely aligned with respect to the opening 4. The longitudinal slot 64 has a definite alignment with respect to the opening 4, and the mechanical assembly is secured in the barrel by the threaded sleeve 52 and the connecting elements against undesired rotation, for example when the forward part is screwed on or off to change cartridges.

Figure 2:
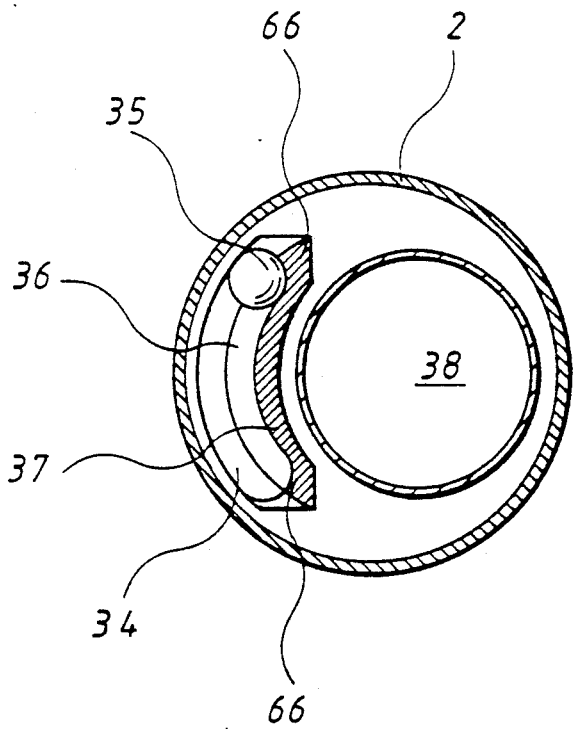
FIG. 2 is an enlarged radial cross section taken along line II—II of FIG. 1.

FIG. 2 shows a section along line II—II in FIG. 1. As it can be seen, the ball 35 is engaged both in the annular groove 34 in the annular portion 32 and in the operating cam 36 configured as a heart cam on the tongue 37 of the cam member 10. The tongue 37 is supported radially inwardly on a surface 66 of the guide member 8. The cam is movable with the tongue 37 perpendicularly to the plane of drawing, with the surfaces 66 assuring that the tongue 37 is reliably held and guided. The cartridge 38 is disposed at an angle to the longitudinal axis of the barrel 2 and lies, as can be seen, off-center in the barrel 2. The tongue 37 with the operating cam 36 is disposed alongside the cartridge 38, so that good use is made of the available space in the barrel 2, and additional length or a larger radius of the writing instrument are not needed to accommodate the operating cam.

Figure 3:
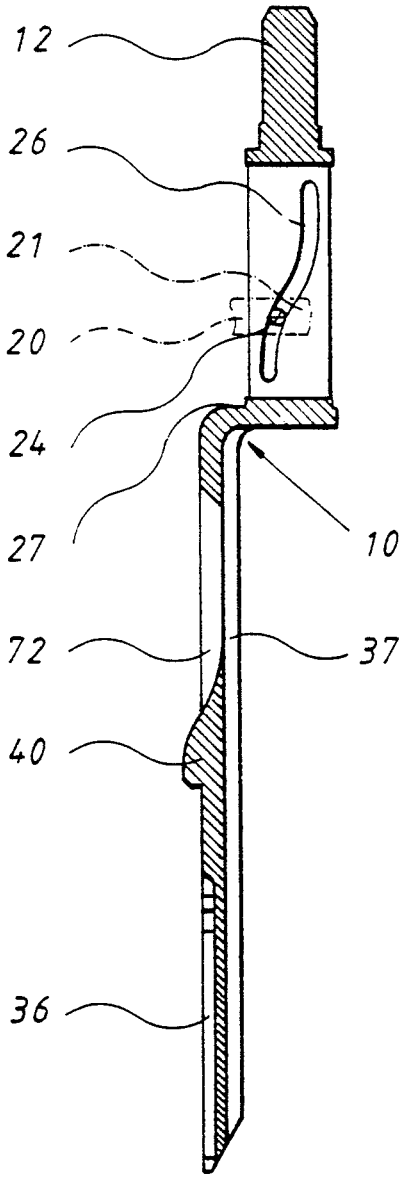
FIGS. 3 and 4 are enlarged views of the cam.
Figure 4:
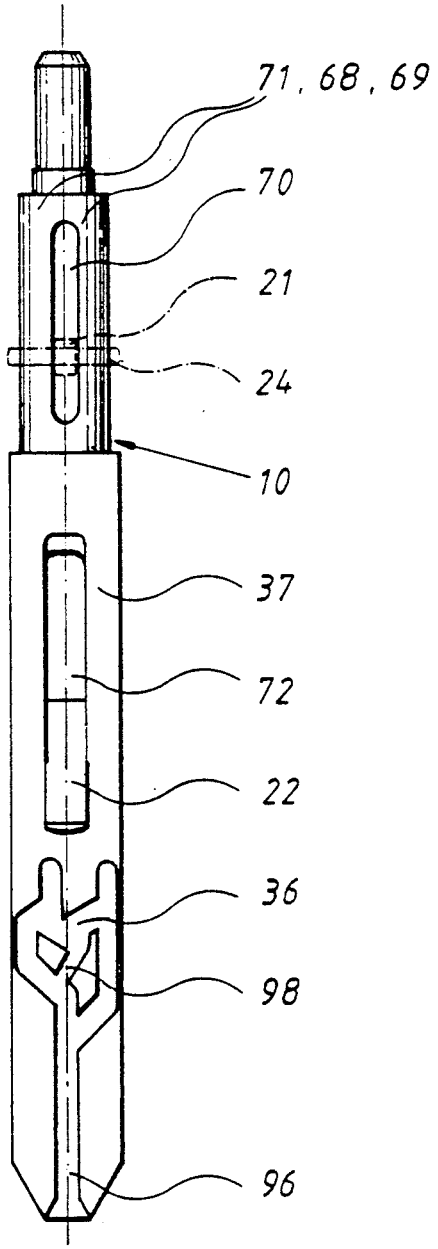

FIGS. 3 and 4 show enlarged views of the cam member 10. In FIG. 4 cam member 10 is shown rotated by 90 around the longitudinal axis 22. In the guide slot 26 can be seen the pin 24 which passes through the end 21 of the clip projection 20. Clip projection 20 engages in an opening 70 in the cam member 10. This opening is situated between two side portions 71 of the cam member 10. The two side portions 71 form a good guide for the projection 20, which has a rectangular cross section, in the opening 70. The ends of the pin 24, which are fixed axially in the guide member 8, project laterally out of the cam member 10. In FIG. 4 the operating cam 36 provided on the front end of the tongue 37 can readily be seen. The cam lobe 40 disposed approximately in the center of the tongue 37 for the forward end of the clip transitions toward the rear into a recess 72 in which the forward end of the clip engages in its retracted position. The operating cam 36, configured as a heart cam, contains as an extension of its forward end a groove 96 which is provided for the installation of the ball. Also of particular importance is a connecting groove 98 which has a shallower depth than the branches of the operating cam 36. This connecting groove 98 serves as overload protection, and makes it possible for the ball, when subjected to impact stress, to pass from the rearward branch to the forward branch of the operating cam 36; the guide member 8 and/or the cam member 10 are formed of a material with sufficient resilient deformability. If the cartridge is in the writing position, then the ball will be in the rearward branch between the two axially parallel portions of the heart cam, about where the line to reference numeral 36 ends in FIG. 4. Now, if for example, the writing instrument falls with the tip of the cartridge onto the floor, then a rearwardly directed force acts through the end of the cartridge on the cam member 10, causing the ball to be forced into the connecting groove 98 and to reach the forward portion of the operating cam 36. In accordance with the invention, the shallower depth of the connecting groove 98, compared to that of the operating cam 36, is determined by the maximum allowable impact stress.

Figure 5:
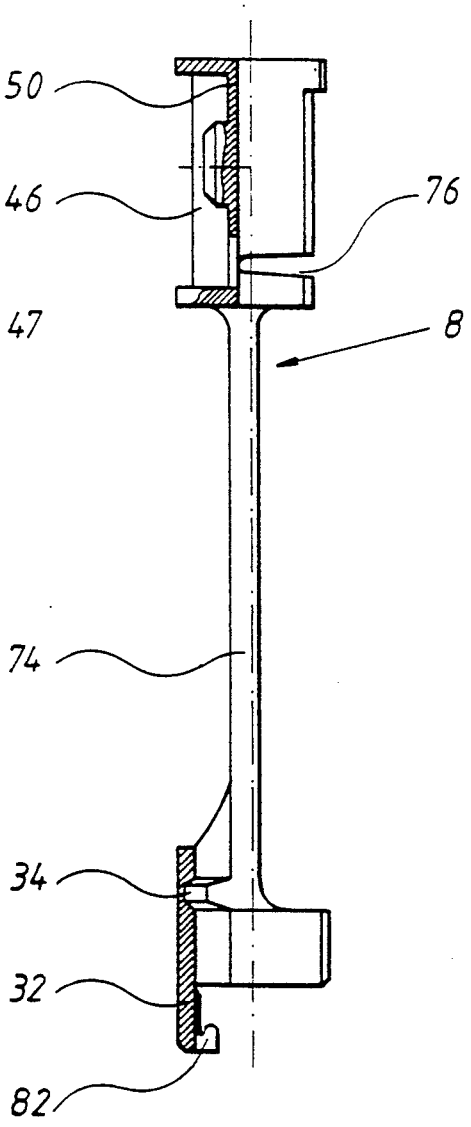
FIGS. 5 and 6 are enlarged views of the guide member.
Figure 6:
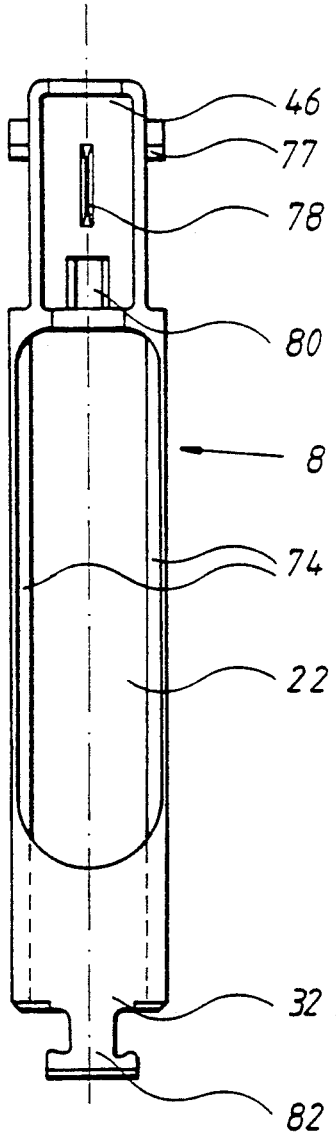

FIGS. 5 and 6 show the guide member 8, which in FIG. 6 is shown in a position turned 90° around the longitudinal axis 22. Two narrow lateral legs 74 are shown, on whose forward end the annular portion 32 is disposed with the groove 34 lying in a radial plane. At the rear the guide member 8 has two lateral slots 76 in a radial plane for the ends of the pin 24 which cooperates with the guide slot 26 of the cam member 10. These slots 76 lock the pin in the direction of the longitudinal axis 22, but the pin can still readily move transversely in the radial plane when the pushbutton is actuated. The guide member 8 is provided at the top with two lateral holding studs 77 which engage two lateral grooves in the top cap when the cap is installed, as will be explained further below. In the opening 46 a projection 78 is disposed for holding the clip spring. In the base 50 of the opening 46 there is an aperture 80 through which the radial projection of the clip is passed. At the front end of the annular portion 32 there is a T-shaped connecting element 82 which serves for connection to the threaded sleeve. The threaded sleeve is provided with a corresponding recess into which the connecting element 82 is introduced during assembly. Thus a connection to which axial tensile forces can be applied is formed between the guide member 8 and the threaded sleeve 52, and which furthermore opposes any relative rotation between them.

Figure 7:
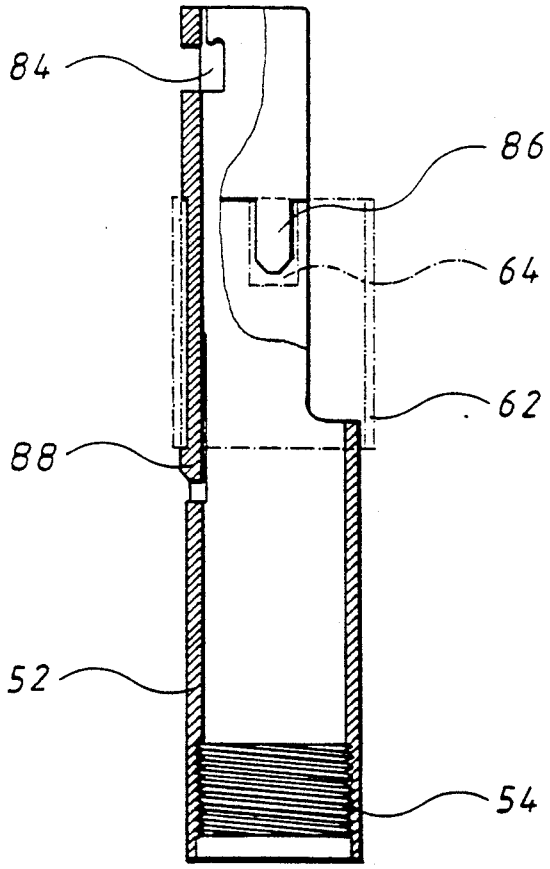
FIG. 7 is an enlarged view of the threaded sleeve.

FIG. 7 is an enlarged view of the threaded sleeve 52 with the T-shaped recess 84 provided at the rearward end, with which the connecting element 82 of guide member 8 cooperates. The threaded sleeve 52 contains two radially extending projections 86 lying diametrically opposite one another, each of which engages one of the above-mentioned longitudinal slots 64 in the sleeve 62 to hold the sleeve radially with respect to the barrel. Furthermore, the threaded sleeve 52 comprises a catch 88 which cooperates with the sleeve 62, shown here in broken lines. The catch 88 hooks behind the forward edge of the sleeve 62 which is fixed to the barrel 2. If, for example, during changing of the cartridge the forward piece is unscrewed out of the internal thread 54 in the threaded sleeve 52, any unintentional ejection of the mechanical assembly that is engaged by the catch 88 with the threaded sleeve 62 is reliably prevented. On the other hand, the catch 88 can be released from the sleeve 62 with an appropriate tool so that the mechanical assembly can be pulled rearwardly out of the housing in case repairs are needed, for example. The threaded sleeve 52 can also be removed rearwardly out of the barrel together with the mechanical assembly, for example for cleaning or repair.

Figure 8:
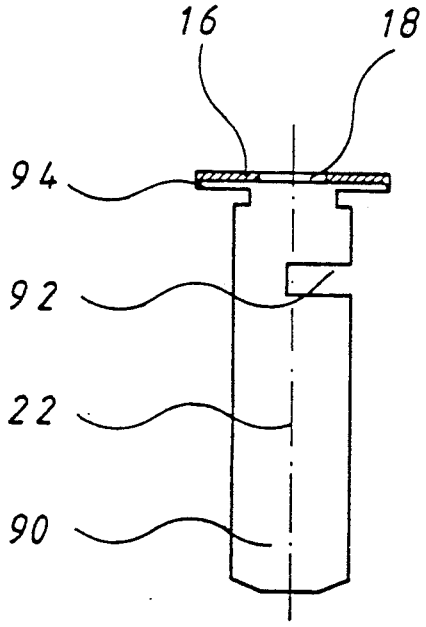
FIGS. 8 and 9 are enlarged views of the top cap.
Figure 9:
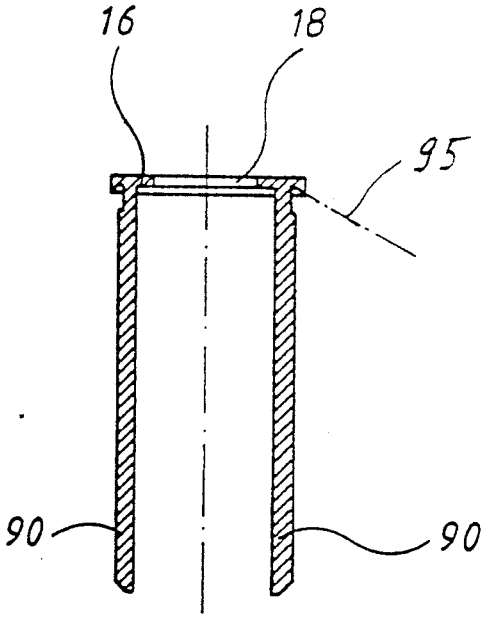

FIGS. 8 and 9 show the top cap 16 with the opening 18 for the pushbutton 12. The opening 18 is off-center from the longitudinal axis 22 to correspond to the cartridge disposed in the barrel at an angle to the longitudinal axis 22. The top cap 16 contains two outwardly facing tabs 90 which are each provided with a slot 92. For assembly, the top cap 16 is pushed from one side radially onto the guide member while the pushbutton is depressed. The lateral holding studs 77 of the guide member 8 will then enter the slots 92, so that the top cap will be axially fixed on the guide member 8. In this manner the guide member, and thus the entire mechanical assembly, is suspended in the top cap 16. The pushbutton 12 is then pushed back and thus slips through the opening 18 in the top cap 16. Then the pushbutton sleeve 14 is snapped in place. The top cap 16 has on its bottom a circumferential undercut 94 which is engaged after assembly by a bevel provided on the rear end of the barrel. As indicated by the broken line 95, the inside surface of the undercut 94 is inclined with respect to the longitudinal axis 22, or conically beveled, the apex of the cone lying outside of the writing instrument. Thus, the rear end of the barrel is reliably held in the undercut, and any radial expansion of the barrel, particularly in the vicinity of opening 46, is prevented even when the writing instrument is subjected to tensile forces.

The writing instrument is simple to assemble. The preassembled mechanical assembly, containing the clip 6, the guide member 8, the cam member 10, the pin 24 and the top cap 16, is inserted together with the threaded sleeve 52 into the tubular barrel 2. First the threaded sleeve 52 is assembled with the mechanical assembly by inserting the connecting element 82 into the correspondingly T-shaped recess 84 in the threaded sleeve 52. The catch 88 of the threaded sleeve 52 can deflect radially inwardly upon insertion into the barrel 2. The insertion is completed when the projections 86 on threaded sleeve 52 enter the longitudinal slots 64 in sleeve 62. After the cartridge 38 is inserted and the front end piece 56, which contains the cartridge spring 39, has been screwed in, the threaded sleeve 52 can still move axially forward, while the mechanical assembly is also pulled forward until the top cap 16 is fully in contact with the upper end of the barrel 2. The top cap 16 with the circumferential bottom undercut 94 overlaps the likewise circumferential bevel of the rear end of the barrel 2, so that expansion of the T-shaped recess 84 is prevented. The barrel 2 is gripped between the top cap 16 and the front end piece 56 according to the principle of the expansion shield. The undercut 94 of the top cap 16 lies against the rearward end of the barrel, while the bead 58 of the front end piece 56 engages the forward end of the barrel, and inside of the barrel, after the forward portion 56 has been screwed into the threaded sleeve, the axial tension forces are transmitted via the recess 84 to the connecting element 82 of the guide member 10. This force proceeds further through the holding studs 77 and the slots 92 to the top cap 16.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A writing instrument comprising a barrel, an ink cartridge arranged within said barrel and having a writing tip, a clip arranged for retraction into an opening in said barrel, a pushbutton, and an operating unit operated by said pushbutton comprising a guide slot for controlling said clip and an operating cam for moving said ink cartridge forward and backward in said barrel to extend or retract said writing tip of said ink cartridge, wherein said guide slot and said operating cam are arranged on a common cam member, said cam member is connected to and actuated by said pushbutton, said clip has a projection which terminates interiorly of said barrel and is engaged with said guide slot; said operating cam is located in a tongue of said cam member, said tongue being arranged alongside the cartridge; said tongue of said cam member comprising a cam lobe which is engaged by a forward end of said clip, and said cam lobe and said guide slot cooperating with one another such that, when the pushbutton is actuated, said clip moves substantially parallel to the longitudinal axis of said barrel.

2. A writing instrument in accordance with claim 1, further comprising a pin engaged with the guide slot and disposed at an inner end of said projection.

3. A writing instrument in accordance with claim 1, wherein the guide slot of the cam member is disposed between the cartridge and the pushbutton, and wherein said operating cam is arranged alongside the cartridge.

4. A writing instrument in accordance with claim 3, wherein said operating cam is configured as a heart cam.

5. A writing instrument in accordance with claim 2, wherein said cam member comprises two lateral portions which define a slot between them, and said projection of said clip is received in said slot between said lateral portions of said cam member.

6. A writing instrument in accordance with claim 5, wherein each of said two lateral portions of said cam member is formed with a guide slot in which a respective end of said pin is received.

7. A writing instrument in accordance with claim 1, wherein a recess is formed in said tongue adjacent the rear of the cam lobe, and said forward end of said clip is received in said recess when said clip is in a retracted position.

8. A writing instrument in accordance with claim 1, further comprising a ball and a groove in said tongue for introducing said ball into said operating cam, said groove extending from said operating cam forwardly along said tongue to the forward end of said tongue.

9. A writing instrument in accordance with claim 8, wherein said operating cam is surrounded by an annular member; at least one of said annular member and said cam member is formed of resiliently deformable material, and said operating cam is configured as a heart cam and comprises rearward and forward portions connected by a connecting groove having a depth shallower than that of said rearward and forward portions; whereby, if the ink cartridge is subjected to an impact, said connecting groove permits the ball to move between the rearward and forward portions of the operating cam.

10. A writing instrument in accordance with claim 9, wherein said resiliently deformable material is a plastic.

11. A writing instrument in accordance with claim 9, wherein only said cam member is formed of resiliently deformable material.

12. A writing instrument in accordance with claim 9, wherein only said annular member is formed of resiliently deformable material.

13. A writing instrument in accordance with claim 1, wherein said clip has a rear end section carrying laterally extending flanks arranged within said barrel and oriented parallel to the longitudinal axis of the barrel, and said flanks have a combined width greater than that of the clip opening in said barrel through which said clip deploys and retracts, whereby when said clip is deployed, said flanks inside said barrel contact the barrel at the sides of said clip opening and assure that the clip is parallel to the barrel.

14. A writing instrument in accordance with claim 1, further comprising a cap attached to the rear end of said barrel, a guide member attached inside said barrel to said cap, a threaded sleeve attached inside said barrel to said guide member, and a front end piece attached inside said barrel to said threaded sleeve and also axially secured at the front of said barrel by a bead which engages the front of the barrel.

15. A writing instrument in accordance with claim 14, wherein said cap has an undercut formed with a conical surface which is engaged by the rear end of said barrel, whereby a radially inward force is exerted on the rear end of said barrel and radial expansion of said barrel is hindered.

16. A writing instrument in accordance with claim 14, wherein said cap has at least one lateral tab formed with a slot therein, said guide member is formed with at least one lateral holding stud thereon, and said guide member is axially attached to said cap by inserting said holding stud in said slot.

17. A writing instrument in accordance with claim 16, wherein said cap comprises two lateral ears each having a slot therein; said guide member is formed with two lateral studs, and said slots and said studs are arranged symmetrically with respect to the longitudinal axis of said barrel.

18. A writing instrument in accordance with claim 14, wherein said cam member has a rear abutment surface which contacts a surface on said guide member in order to limit movement of said cam member toward the rearward end of the barrel.

19. A writing instrument in accordance with claim 14, further comprising a spring engaging a rear end section of said clip for urging said clip toward a clamping position.

20. A writing instrument in accordance with claim 19, wherein said spring is arranged in a recess in the rear end of said guide member.

21. A writing instrument in accordance with claim 20, wherein, when said clip is retracted, said rear end section of said clip is at least partially in contact with a bottom surface of said recess in the rear end of said guide member.

22. A writing instrument in accordance with claim 1, further comprising a guide member for said cam member, wherein said guide member comprises an annular portion which surrounds said cartridge, said annular portion having an inner surface with a groove formed therein which extends over a given circumferential angle, and a ball is arranged in said groove in engagement with said operating cam.

23. A writing instrument in accordance with claim 22, wherein said annular portion is spaced a distance from the rearward end of the barrel.

24. A writing instrument in accordance with claim 23, wherein said annular portion arranged substantially midway between front and rear ends of said barrel.

25. A writing instrument in accordance with claim 24, wherein said annular portion is attached to a forward end of said guide member by connecting legs.

26. A writing instrument in accordance with claim 24, wherein said guide member and said annular portion carry a supporting surface for said tongue of said cam member.

27. A writing instrument in accordance with claim 22, further comprising a threaded sleeve disposed in the forward end of said barrel, and a front end piece which can be screwed into said threaded sleeve.

28. A writing instrument in accordance with claim 27, wherein said threaded sleeve is attached to said guide member by a connecting element formed on said guide member engagingly received in a corresponding recess in said threaded sleeve.

29. A writing instrument in accordance with claim 27, wherein said front end piece has a bead which engages the forward end of said barrel.

30. A writing instrument in accordance with claim 29, wherein said barrel has an internal sleeve fixedly mounted therein, said internal sleeve having at least one guide slot formed therein for positioning said threaded sleeve in said barrel.

* * * * *